US007784648B2

(12) United States Patent
Hefele

(10) Patent No.: US 7,784,648 B2
(45) Date of Patent: Aug. 31, 2010

(54) PRESS-OUT TOOL

(75) Inventor: Christian Hefele, Breitenbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 409 days.

(21) Appl. No.: 12/069,952

(22) Filed: Feb. 13, 2008

(65) Prior Publication Data

US 2008/0205969 A1 Aug. 28, 2008

(30) Foreign Application Priority Data

Feb. 28, 2007 (DE) ..... 10 2007 000 118

(51) Int. Cl.
*B67D 7/60* (2010.01)

(52) U.S. Cl. ..... 222/391

(58) Field of Classification Search ..... 222/391, 222/327, 402, 135–137; 401/171–179
See application file for complete search history.

(56) References Cited

U.S. PATENT DOCUMENTS 4,669,636 A * 6/1987 Miyata ..... 222/153.01
5,386,931 A * 2/1995 Jacobsen et al. ..... 222/327
5,595,327 A * 1/1997 Dentler et al. ..... 222/327
5,871,354 A * 2/1999 Kunkel et al. ..... 433/89
7,306,125 B2 * 12/2007 Takahashi et al. ..... 222/391

* cited by examiner

*Primary Examiner*—Lien T Ngo
(74) *Attorney, Agent, or Firm*—Abelman, Frayne & Schwab

(57) ABSTRACT

A press-out tool for squeezing material out of containers (7) containing single-component or multi-component substances, has a receiving space (12) for the container (7), a piston rod (16) having a first end (17) which can dip into the receiving space (12), a first guide portion (18) and a second guide portion (20) that extends from an end area of the first end (17) of the piston rod (16) to the first guide portion (18) and has a cross-section with a reduced height in comparison with the height of the cross-section of the first guide portion (18), and a displacement mechanism (26) having a driving device (28) and a clamping lever (27) through which the piston rod (16) extends and which is pivotable relative to the longitudinal axis (L) of the piston rod (16).

10 Claims, 2 Drawing Sheets

PRESS-OUT TOOL

BACKGROUND OF THE INVENTION

1. Field of the Invention

The invention relates to a press-out tool for squeezing material out from containers containing single-component or multi-component substances, and having a receiving space for the container, at least one piston rod having a first end which can plunge into the receiving space, and a displacement mechanism having a driving device and a clamping lever through which the piston rod extends and which is pivotable relative to the longitudinal axis of the piston rod. The at least one piston rod has a first guide portion for the clamping lever.

2. Description of the Prior Art

A press-out tool of the type mentioned above for squeezing out material out of containers, e.g., foil bags or cartridges, which contain single-component or multi-component substances such as mortar, sealing compounds and the like, is known from U.S. Pat. No. 4,338,925, for example. A discharge lever acting on the pivotable clamping lever is provided as a driving device. When the discharge lever is actuated, the clamping lever is pivoted by the amount defined by the maximum stroke generated by the discharge lever. In the basic position of the clamping lever, which corresponds at least to a position oriented perpendicular to the longitudinal axis of the piston rod, the piston rod is in the idling position. When the clamping lever is pivoted, it enters into a clamping engagement with the piston rod and advances the piston rod by the corresponding amount. A press plate is provided as pressure transmitting means at the end of the piston rod dipping into the receiving space and transmitting the displacement force to the substance to be dispensed. After each actuation of the driving device, the clamping lever is brought back again into its substantially perpendicular starting position by means of a spring element. To place a new container in the receiving space of the press-out tool, the piston rod is pulled back counter to the pressing direction and the container is then inserted.

A disadvantage in the known solution consists in that the press plate does not penetrate correctly into the container when the piston rod is advanced if the container is not fully inserted. In the case of a cartridge, for example, this can lead to damage of the press plate, the cartridge, or even the press-out tool.

SUMMARY OF THE INVENTION

It is the object of the invention to improve the usability of a press-out tool for squeezing out material from containers containing single-component or multi-component substances.

This and other objects of the present invention which will become apparent hereinafter, are achieved by providing a press-out tool in which the at least one piston rod has a second guide portion for the clamping lever which extends from an end area of the first end of the piston rod to the first guide portion and has a cross-section with reduced height compared to the height of the cross-section of the first guide portion.

The height of the cross-sections is measured in the plane of the clamping lever. In a retracted position of the piston rod in which a new container can be inserted into the receiving space of the press-out tool, the displacement of the piston rod is effected with a reduced force or even absent when the driving device is actuated because of the reduced cross-sectional length of the second guide portion which is made available at the start of the pressing-out process, in comparison with the cross-sectional length for clamping. In order to advance the piston rod by the displacement mechanism after a new container has been placed in the press-out tool, the displacement mechanism must be displaced over a certain distance until the entire displacement force generated by the driving device acts on the piston rod. If the container is not inserted correctly and pressure transmitting means at the first end of the piston rod accordingly do not fully engage in the container, no damage to the pressure transmitting means, container, or press-out tool will occur in spite of an actuation of the driving device. The destruction of structural component parts of the press-out tool because of the container not being fully inserted, is substantially avoided with the press-out tool according to the invention, which ensures a high degree of certainty in the system and a long service life of the press-out tool.

The at least one piston rod forms a path-controlled displacement control means for the displacement of the piston rod. The displacement and, therefore, the path of the piston rod is controlled based on the different cross-sections of the piston rod corresponding to the position of the piston rod in the press-out tool. Therefore, because of the cross-section of the second guide portion with the reduced height, the clamping lever must be pivoted to a greater degree until it cooperates with the piston rod in a clamping manner and advances the piston rod in a corresponding manner.

The length of the second guide portion in direction of the longitudinal axis of the piston rod is advantageously selected in such a way that the full displacement force is not transmitted to the piston rod by the driving device of the displacement mechanism even when the at least one piston rod is in its manually displaced state at the start of the squeeze-out process. The reduction in the height of the cross-section is advantageously formed symmetrically with the longitudinal axis of the piston rod.

The at least one piston rod preferably has a third guide portion remote from the first end and adjoining the first guide portion. The third guide portion has a cross-section with a reduced height compared to the height of the cross-section of the first guide portion. Therefore, the displacement force is controlled at the end of the pressing-out process rather than at the start of the pressing-out process, depending on the distance traveled by the piston rod.

The cross-section of the second and/or the third guide portion with reduced height is preferably round, which ensures a simple production of the corresponding guide portion with reduced height of the at least one piston rod. Further, the first guide portion also advantageously has a round cross-section, and the second guide portion and/or third guide portion are/is advantageously arranged coaxially with the first guide portion.

In another embodiment according to the invention, the cross-section of the second and/or third guide portion with the reduced height is non-round which provides for a reduced transmission of the displacement force and which enables only a partial clamping of the clamping lever with the piston rod. The decrease of the reduced height takes place advantageously symmetrically relative to the longitudinal axis of the piston rod. It is further advantageous when the cross-section with the reduced height has an oval shape whose extension along the main axis corresponds approximately to the corresponding dimension of the cross-section of the first guide portion of the piston rod with a non-reduced height.

For example, the cross-section, which is reduced in height, can have a clamping area which is reduced in such a way that the clamping lever slips through a certain area of the at least one piston rod when the driving device is actuated. In mechanical press-out tools, for example, because of the lever arrangement, a constant force is usually transmitted to the clamping lever which transmits a corresponding displacement force to the piston rod. When the clamping surface is reduced, the clamping or friction between the clamping lever and the at least one piston rod is overcome, which prevents further transmission of the displacement force.

When the at least one piston rod has a second guide portion and a third guide portion, they are formed in accordance with the requirements for increasing or decreasing the displacement force applied to the piston rod. The second guide portion and the third guide portion can have the same or a similar cross-section. Alternatively, the second guide portion and the third guide portion can also have different cross-sections. The same is true with respect to the reduction in the height of the second guide portion and the third guide portion in itself.

The reduced height advantageously corresponds to 0.7-times to 0.98-times of the corresponding height of the cross-section of the first guide portion of the piston rod. In a particularly advantageous manner, the reduced height corresponds to 0.9-times to 0.96-times of the corresponding height of the cross-section of the first guide portion. The ratio is selected in accordance with the desired control of the transmission of force from the clamping lever to the piston rod.

The reduction in the height of the cross-section in the second guide portion preferably decreases starting from the first end of the piston rod, advantageously in a uniform manner, so that the clamping lever has to be pivoted to a lesser and lesser degree for advancing the piston rod with continuous actuation of the driving device.

The reduction in the height of the cross-section in the third guide portion preferably increases, advantageously in a uniform manner, proceeding from the first guide portion of the piston rod with the cross-section that is not reduced in height so that the piston rod has to be pivoted to a greater and greater degree for advancing the piston rod, with continuous actuation of the driving device.

The reduction in height preferably proceeds at least partially in a strictly uniform or continuous manner. As soon as the clamping lever clampingly engages the piston rod at the start of the pressing-out process, the clamping force in the second guide portion increases with every actuation of the driving device until reaching the first guide portion of the piston rod with the cross-section that is not reduced in height.

In this area of the first guide portion of the piston rod, the full clamping force is transmitted with every actuation of the driving device for advancing the piston rod. While the reduction in the height of the cross-section also proceeds continuously in the third guide portion at least partially, the clamping force decreases as the displacement increases because the clamping of the clamping lever with the piston rod is only limited or does not take place at all with continuous actuation of the driving device.

Alternatively, the reduction in the height of the cross-section proceeds in a constant manner at least along an area of the second guide portion and/or of the third guide portion. Further, the reduction in the height of the cross-section can be carried out in a stepped manner so that a plurality of areas of the second guide portion and/or of the third guide portion with different force transmission areas are/is created.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

In the drawings, identical parts are provided with the same reference numerals.

DETAILED DESCRIPTION OF THE PREFERRED EMBODIMENTS

Figure 1:
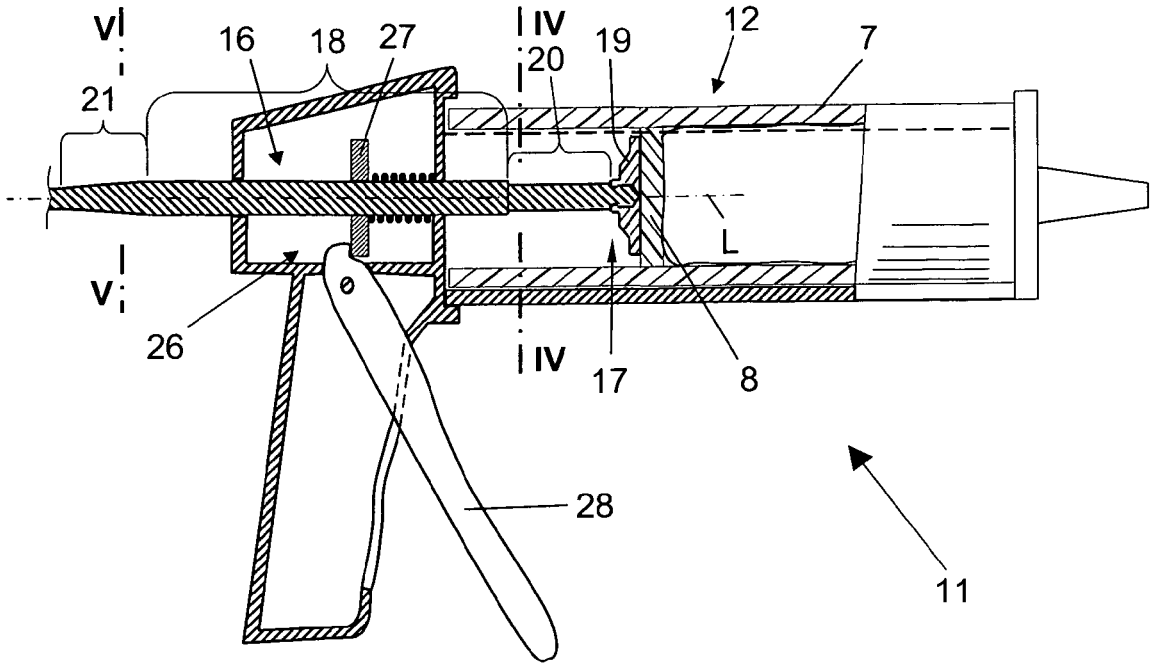
FIG. 1 a side partially cross-sectional view of a press-out tool according to the present invention.

The press-out tool 11 shown in FIGS. 1 to 6 for squeezing material out of a container 7 containing single-component or multi-component substance has a receiving space 12 for the container 7, a piston rod 16 which has a first end 17 that can dip into the receiving space 12, and a displacement mechanism 26 for the piston rod 16 and having a driving device 28 in the form of a discharge lever and a clamping lever 27 through which the piston rod 16 extends and which is pivotable relative to the longitudinal axis L of the piston rod 16.

A press plate 19, which cooperates with a press-out piston 8 of the container 7, is provided as pressure transmission means at the first end 17 of the piston rod 16. Further, the piston rod 16 has a second guide portion 20 that extends from an end area of the first end 17 and a first guide portion 18. The second guide portion 20 extends from the first end 17 of the piston rod 16 to the first guide portion 18 and has a cross-section with a reduced height E in comparison with the cross-section of the first guide portion 18. Further, the piston rod 16 has a third guide portion 21 remote from the first end 17 and adjoining the first guide portion 18. The third guide portion 21 has a cross-section with a reduced height F in comparison with the cross-section of the first guide portion 18.

Figure 4:
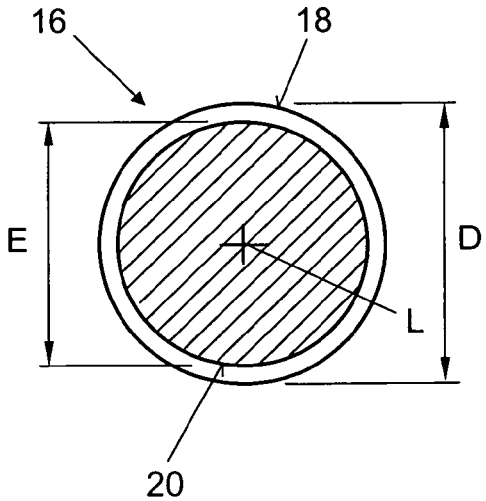
FIG. 4 a cross-sectional view of the piston rod along line IV-IV in FIG. 1.

As can be seen particularly in FIG. 4, the first guide portion 18 and the second guide portion 20 both have a round cross-section, the second guide portion 20 being arranged coaxial with the first guide portion 18. The height E or diameter of the cross-section of the second guide portion 20 corresponds to 0.9-times of the height D or diameter of the cross-section of the first guide portion 18 of the piston rod 16. All heights D, E and F relate, respectively, to a dimension of the corresponding guide section 18, 20 or 21 in the plane of the clamping lever 27.

As an alternative to a cross-section having a constant height in the second guide portion 20, the latter can decrease uniformly, proceeding from the first end 17 of the piston rod 16.

Figure 5:
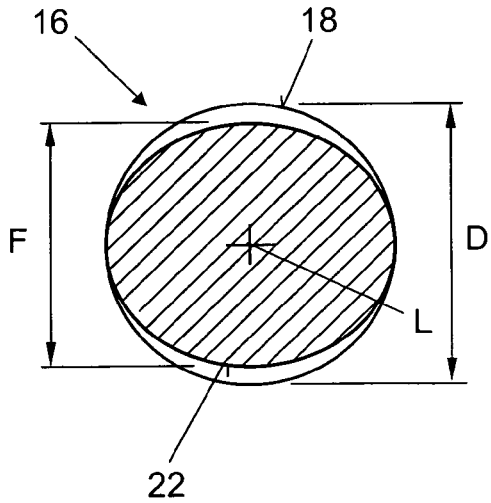
FIG. 5 a cross-sectional view of the piston rod along line V-V in FIG. 1.
Figure 6:
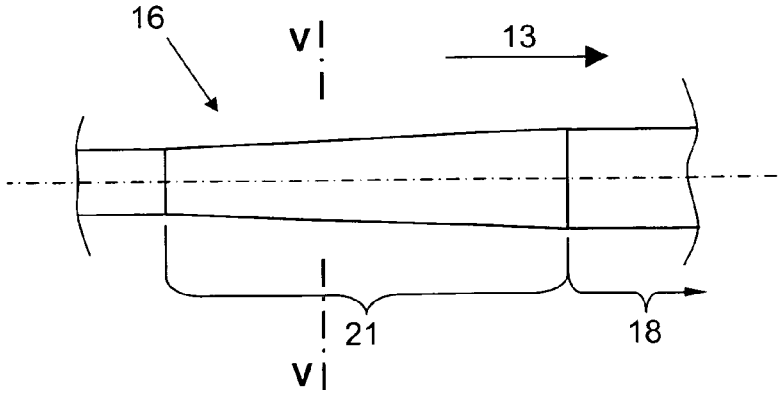
FIG. 6 a side view of the third guide portion of the piston rod.

As is shown in FIGS. 5 and 6, the cross-section of the third guide portion 21 is nonround or is oval and is formed so as to decrease in a strictly uniform manner proceeding from the first guide portion 18 of the piston rod 16 so that the reduction in the height F of the cross-section of the third guide portion 21 is continuous. The reduction in the height F of the third guide portion 21 is symmetrical relative to the height D of the cross-section of the first guide portion 18.

Figure 2:
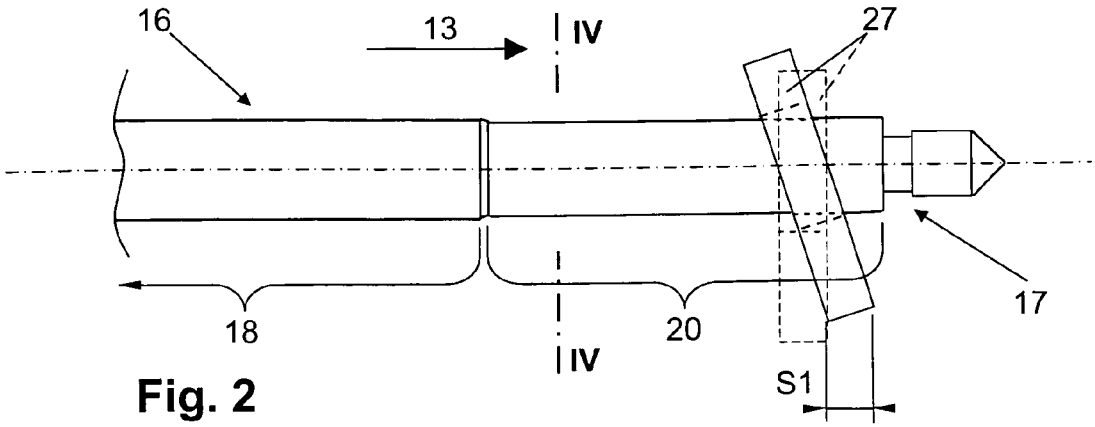
FIG. 2 an enlarged, in comparison with FIG. 1, side view of the first end of a piston rod of the inventive press-out tool in the retracted position of the piston rod.
Figure 3:
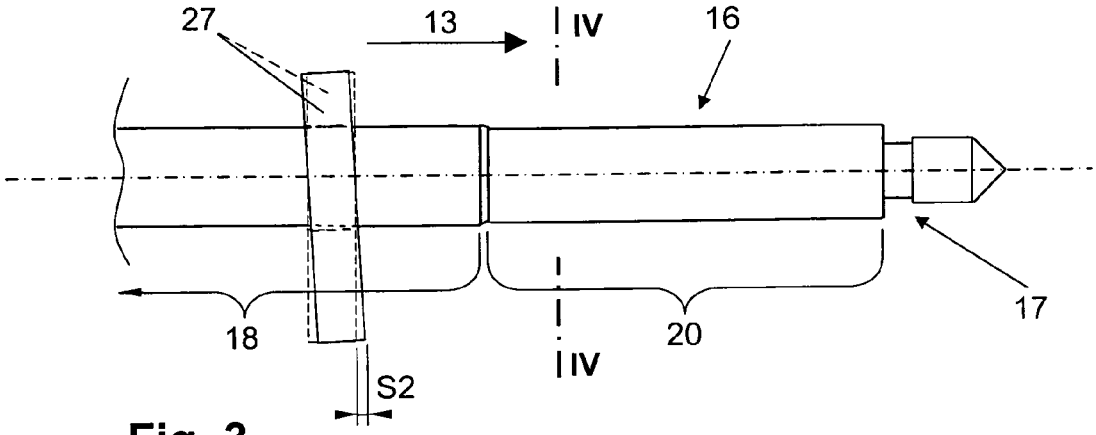
FIG. 3 a side view of the first end of the piston rod shown in FIG. 2 in the advanced position of the piston rod.

The advantageous manner of operation of the press-out tool according to the invention will be described below with reference to FIGS. 2 and 3. The clamping lever 27 is shown in FIGS. 2 and 3 in its initial position (with a dash line) and in its pivoted position (with solid lines). In FIG. 2, the piston rod 16 is located in the retracted position in which the container 7 can be inserted into the receiving space 12 of the press-out tool 11. In this position of the piston rod 16, the clamping lever 27 acts on the piston rod 16 at the second guide portion 20. Because of the reduced height E of the cross-section of the second guide portion 20, the clamping lever 27 must be pivoted by distance S 1 when the driving device 28 is actuated for a clamping cooperation of the clamping lever 27 with the piston rod 16. In this position of the piston rod 16, no displacement force or only limited displacement force is transmitted from the clamping lever 27 to the piston rod 16.

By manually advancing the piston rod 16 in the press-out direction 13 or by repeated actuation of the driving device 28, the clamping lever 27 enters into an increasingly stronger clamping engagement with the first guide portion 18 of the piston rod 16 when being pivoted. Due to the greater height D of the cross-section of the first guide portion 18 compared to the second guide portion 20, the maximum possible path S2 during the pivoting of the clamping lever 27 is substantially smaller than the above-mentioned path S1. In the area of the first guide portion 18, the full clamping force and accordingly the full displacement force is transmitted from the clamping lever 27 to the piston rod 16 every time the driving device 28 is actuated.

When the clamping lever comes into contact with the piston rod 16 in the area of the third guide portion 21, the displacement force acting on the piston rod 16 is reduced because of the continuous reduction in the height F of the cross-section of the third guide portion 21.

Though the present invention was shown and described with references to the preferred embodiments, those are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A press-out tool for squeezing material out of a container (7) containing single-component or multi-component substances, comprising a receiving space (12) for the container (7); at least one piston rod (16) having a first end (17) which can dip into the receiving space (12); and a displacement mechanism (26) for displacing the at least one piston rod and having a driving device (28) and a clamping lever (27) through which the piston rod (16) extends and which is pivotable relative to the longitudinal axis (L) of the piston rod (16), the piston rod (16) having a first guide portion (18) for the clamping lever (27) and a second guide portion (20) for the clamping lever (27) which extends from an end area of the first end (17) of the piston rod (16) to the first guide portion (18) and has a cross-section with reduced height (E) in comparison with a height (D) of the cross-section of the first guide portion (18).

2. A press-out tool according to claim 1, wherein the at least one piston rod (16) has a third guide portion (21) remote from the first end (17) and adjoining the first guide portion (18) and having a cross-section with a reduced height (F) in comparison with the height (D) of the cross-section of the first guide portion (18).

3. A press-out tool according to claim 1, wherein the cross-section of the second guide portion (20) is round.

4. A press-out tool according to claim 1, wherein the cross-section of the second guide portion (20) is non-round.

5. A press-out tool according to claim 1, wherein the cross-section of the third guide portion (20) is round.

6. A press-out tool according to claim 1, wherein the cross-section of the third guide portion (20) is non-round.

7. A press-out tool according to claim 1, wherein the height of the cross-section of the second guide portion (20) decreases, starting from the first end (17) of the piston rod (16).

8. A press-out tool according to claim 2, wherein the height of the cross-section of the third guide portion (21) decreases proceeding from the first guide portion (18) of the piston rod (16).

9. A press-out tool according to claim 5, wherein reduction in height of second guide portion (20) proceeds, at least partially, in a strictly uniform manner.

10. A press-out device according to claim 6, wherein the reduction in height of the third guide portion (21) proceeds, at least partially, in a strictly uniform manner.

* * * * *